US010670047B2

(12) United States Patent
Song et al.

(10) Patent No.: US 10,670,047 B2
(45) Date of Patent: Jun. 2, 2020

(54) CENTRIFUGAL FAN

(71) Applicant: LG ELECTRONICS INC., Seoul (KR)

(72) Inventors: Kiwook Song, Seoul (KR); Jinsoo Kim, Seoul (KR); Dongwook Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 499 days.

(21) Appl. No.: 15/274,729

(22) Filed: Sep. 23, 2016

(65) Prior Publication Data

US 2017/0089356 A1 Mar. 30, 2017

(30) Foreign Application Priority Data

Sep. 24, 2015 (KR) ..... 10-2015-0135817

(51) Int. Cl.

| | |
|---|---|
| ***F04D 29/42*** | (2006.01) |
| ***F04D 29/28*** | (2006.01) |
| ***F04D 17/16*** | (2006.01) |
| ***F04D 25/02*** | (2006.01) |

(52) U.S. Cl.

CPC ..... *F04D 29/4233* (2013.01); *F04D 17/16* (2013.01); *F04D 25/02* (2013.01); *F04D 29/281* (2013.01); *F04D 29/283* (2013.01); *F04D 29/422* (2013.01); *F04D 29/4206* (2013.01)

(58) Field of Classification Search

CPC .. F04D 29/281; F04D 29/283; F04D 29/4206; F04D 29/422; F04D 29/4233; F04D 25/02; F04D 17/16

See application file for complete search history.

(56) References Cited

U.S. PATENT DOCUMENTS

| | | | | |
|---|---|---|---|---|
| 3,407,995 | A * | 10/1968 | Kinsworthy ..... | F04D 17/161 415/147 |
| 5,474,422 | A | 12/1995 | Sullivan | |
| 5,839,879 | A | 11/1998 | Kameoka et al. | |
| 6,050,772 | A | 4/2000 | Hatakeyama et al. | |

(Continued)

FOREIGN PATENT DOCUMENTS

| | | | |
|---|---|---|---|
| CN | 104180437 | A | 12/2014 |
| CN | 104533835 | A | 4/2015 |

(Continued)

*Primary Examiner* — Dwayne J White
*Assistant Examiner* — Danielle M. Christensen
(74) *Attorney, Agent, or Firm* — Dentons US LLP

(57) ABSTRACT

A centrifugal fan includes: an impeller configured to suction or discharge air; a motor configured to rotate the impeller; a housing configured to accommodate the impeller and have a suction port through which air is suctioned by rotation of the impeller and a discharge port through which air is discharged by rotation of the impeller; and a cut-off portion formed on one side of the discharge port. A flow cross-sectional area of air flowing in the housing is gradually increased from the cut-off portion to the discharge port in an air flow direction, and a distance from a lower portion of the impeller to an inner peripheral surface of the housing in a rotational axis direction of the impeller is gradually increased in at least a portion from the cut-off portion to the discharge port in the air flow direction.

8 Claims, 4 Drawing Sheets

(56) References Cited

U.S. PATENT DOCUMENTS

| | | | | |
|---|---|---|---|---|
| 6,224,335 | B1 * | 5/2001 | Parisi | F04D 29/162 415/206 |
| 2005/0207886 | A1 | 9/2005 | Chen et al. | |
| 2008/0207886 | A1 | 8/2008 | Conklin et al. | |
| 2012/0141262 | A1 | 6/2012 | Kim et al. | |

FOREIGN PATENT DOCUMENTS

| | | | |
|---|---|---|---|
| JP | 05-231379 | A | 9/1993 |
| KR | 10-2002-0026045 | A | 4/2002 |
| KR | 10-2003-0063901 | A | 7/2003 |
| KR | 10-2004-0016709 | A | 2/2004 |
| KR | 10-0619790 | A | 8/2006 |

* cited by examiner

CENTRIFUGAL FAN

CROSS-REFERENCE TO RELATED APPLICATIONS

The present application claims priority under 35 U.S.C. 119 and 35 U.S.C. 365 to Korean Patent Application No. 10-2015-0135817 (filed on Sep. 24, 2015), which is hereby incorporated by reference in its entirety.

BACKGROUND

The present disclosure relates to a centrifugal fan.

A centrifugal fan, which is a type of an air blower, is driven by a motor and blows air from an inside of an impeller in a circumferential direction through rotation of the impeller due to a centrifugal force. Generally, the centrifugal fan is used in a device that requires a flow rate and a pressure. As an example, the centrifugal fan is used in an air conditioner, a dryer, a hair dryer, or the like.

The centrifugal fan includes a housing, an impeller accommodated in the housing, and a motor for rotating the impeller. Outside air is introduced into the housing in an axial direction of the impeller, is compressed, and is then discharged in a rotational direction of the impeller. Discharge flow rate performance of the centrifugal fan is affected by a shape of the impeller, performance of the motor, a shape of the housing, or the like.

Korean Patent Application Publication No. 10-2004-0016709, entitled "FLOW GUIDE APPARATUS FOR CENTRIFUGAL FAN" is hereby incorporated by reference.

SUMMARY

Embodiments provide a centrifugal fan which has improved discharge flow rate performance by changing an inner channel structure of the centrifugal fan.

In one embodiment, a centrifugal fan includes: an impeller; a housing; and a cut-off portion formed on one side of a discharge port, wherein a flow cross-sectional area of air flowing in the housing is gradually increased from the cut-off portion to the discharge port in an air flow direction, and a distance from a lower portion of the impeller to an inner peripheral surface of the housing in a rotational axis direction of the impeller is gradually increased in at least a portion from the cut-off portion to the discharge port in the air flow direction.

The details of one or more embodiments are set forth in the accompanying drawings and the description below. Other features will be apparent from the description and drawings, and from the claims.

DETAILED DESCRIPTION OF THE EMBODIMENTS

Figure 1:
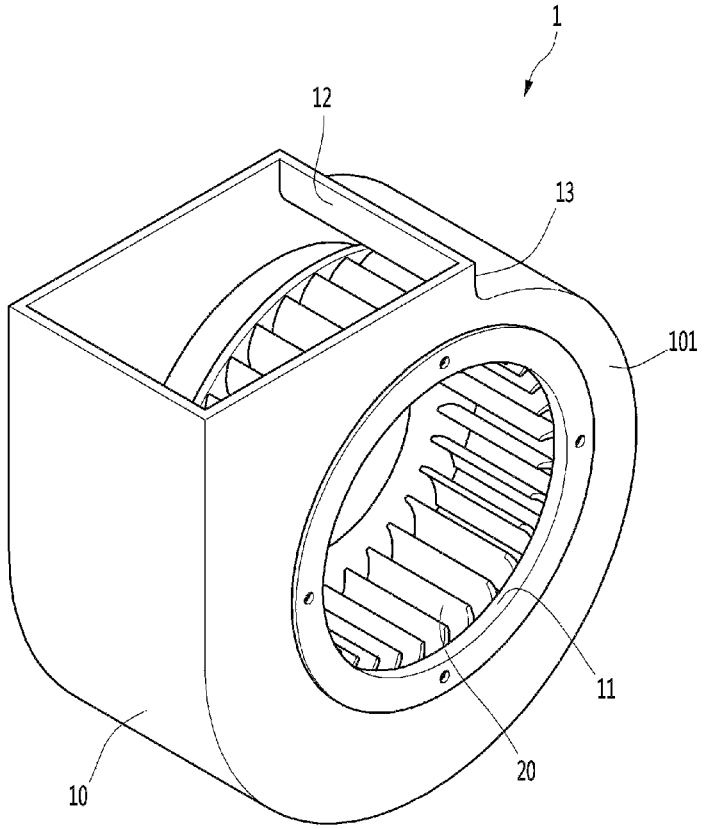
FIG. 1 is a perspective view illustrating a centrifugal fan according to an embodiment of the present disclosure.

Hereinafter, some embodiments of the present disclosure will be described in detail with reference to the exemplary drawings. In the following description, the same elements will be designated by the same reference numerals although they are shown in different drawings. Further, in the following description of embodiments of the present disclosure, a detailed description of known functions and configurations incorporated herein will be omitted when it may make the subject matter of the present disclosure rather unclear.

Additionally, in describing the components of the present disclosure, there may be terms used like first, second, A, B, (a), and (b). These are solely for the purpose of differentiating one component from the other and not to imply or suggest the substances, order or sequence of the components. If a component is described as "connected", "coupled", or "linked" to another component, they may mean the components are not only directly "connected", "coupled", or "linked" but also are indirectly "connected", "coupled", or "linked" via a third component.

Figure 2:
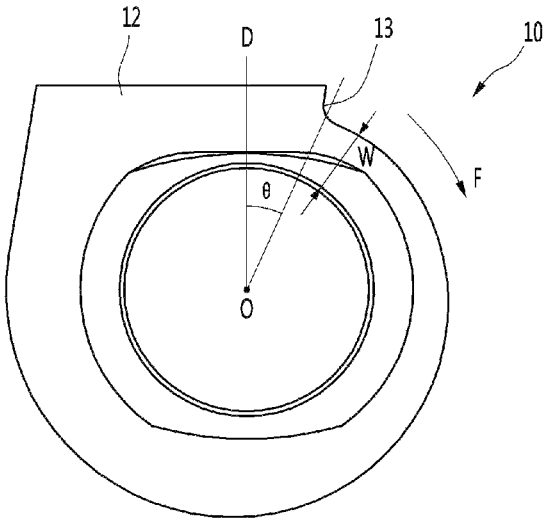
FIG. 2 is a view illustrating an internal shape of a housing of FIG. 1.

FIG. 1 is a perspective view illustrating a centrifugal fan according to an embodiment of the present disclosure, and FIG. 2 is a view illustrating an internal shape of a housing of FIG. 1.

Referring to FIGS. 1 and 2, a centrifugal fan 1 according to an embodiment of the present disclosure includes a housing 10, an impeller 20, and a motor (not shown).

The impeller 20 is configured to suction or discharge outside air. The impeller 20 may be rotatably mounted in the housing 10, and the motor may be connected to the impeller 20 to rotate the impeller 20.

A suction port 11 through which outside air is suctioned and a discharge port 12 through which air is discharged are formed in the housing 10.

The suction port 11 is formed in a side portion 101 of the housing 10. Air introduced from the outside flows toward a rotational axis O of the impeller 20 through the suction port 11. The discharge port 12 may be formed in a radial direction of the impeller 20. That is, the suction port 11 and the discharge port 12 are formed perpendicular to each other.

Therefore, air introduced into the housing 10 through the suction port 11 can be discharged through the discharge port 12 in the radial direction. An air channel in the housing 10 may be formed to have a scroll shape.

A cut-off portion 13 may be formed on one side of the discharge port 12. A width W of the air channel formed in the housing 10 is gradually increased from the cut-off portion 13 in a rotational direction of the impeller 20.

In addition, it may be considered that a distance from the rotational axis O of the impeller 20 to an inner peripheral surface 10A of the housing 10 in the radial direction of the impeller 20 is gradually increased from the cut-off portion 13 to the discharge port 12 in an air flow direction Therefore, a flow cross-sectional area of the air channel is also increased from the cut-off portion 13 in the rotational direction of the impeller 20, i.e., the air flow direction F.

Air introduced through the suction port 11 flows toward the discharge port 12 along the air channel gradually expanded from the cut-off portion 13. Air discharged through the discharge port 12 is discharged to the outside of the discharge port 12 while a static pressure is recovered from a dynamic pressure around the discharge port 12.

Meanwhile, an angle θ between an air discharge direction D and the cut-off portion 13 may be in a range of about 10° to about 15° at the discharge port 12.

Figure 3:
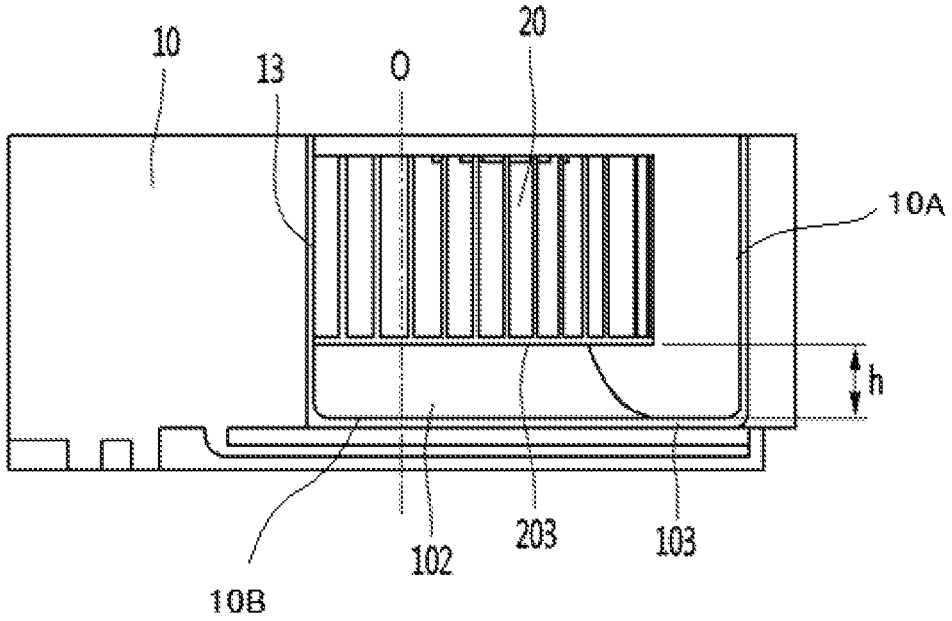
FIG. 3 is a view illustrating the centrifugal fan of FIG. 1 when viewed from a discharge port.
Figure 4:
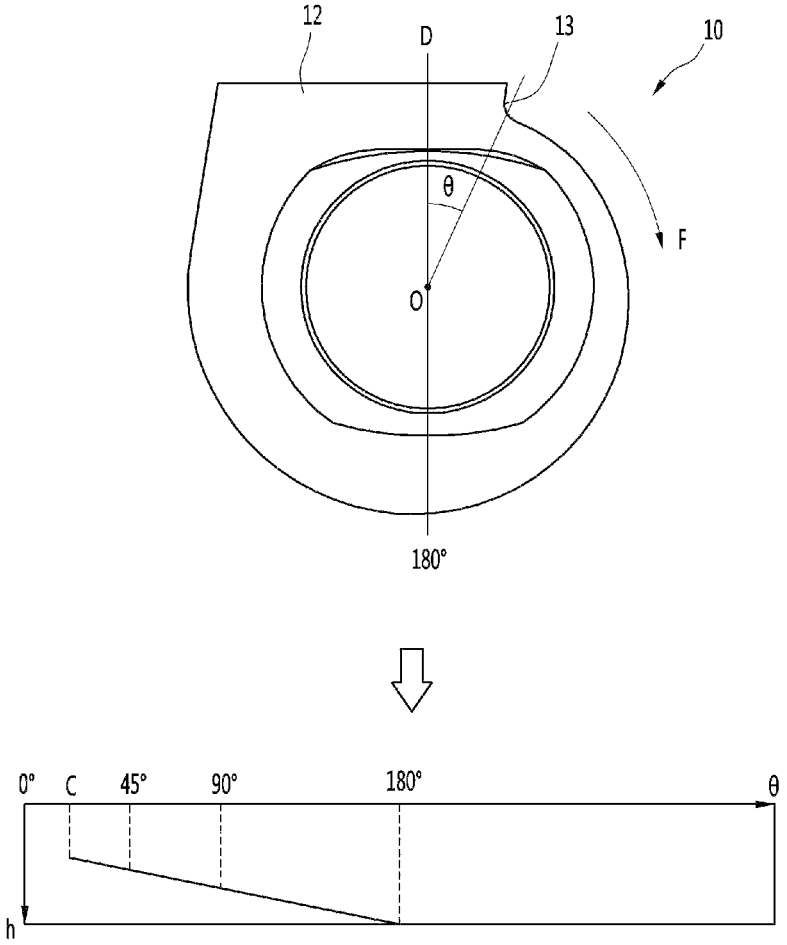
FIG. 4 is a view illustrating a height change amount of a flow cross-sectional area according to an angle formed by one certain point and an air discharge direction in an air channel.

FIG. 3 is a view illustrating the centrifugal fan of FIG. 1 when viewed from the discharge port, and FIG. 4 is a view illustrating a height change amount of a flow cross-sectional area according to an angle formed by one certain point and an air discharge direction in an air channel.

Referring to FIGS. 3 and 4, the impeller 20 may rotate in a state of being mounted on a mounting portion 102 provided in the housing 10. The mounting portion 102 may be formed to protrude from a lower portion 103 inside of the housing 10.

Therefore, a lower portion 203 of the impeller 20 is spaced apart from the lower portion 103 of the housing 10 by a certain interval h. Therefore, the certain interval h may be defined as a distance from the lower portion 203 of the impeller 20 to an inner side surface 10B of the lower portion 103 of the housing 10 in a rotational axis (O) direction of the impeller 20.

The interval h from the lower portion 203 of the impeller 20 to the lower portion 103 of the housing 10 may be gradually increased from the cut-off portion 13 to the discharge port 12 in the air flow direction F.

That is, a height of the lower portion 103 of the housing 10 is gradually lowered toward the discharge port 12 in the air flow direction F.

The interval h may be increased up to a point that forms an angle of 180° with the air discharge direction D, and may be constant from the point forming the angle of 180° to the discharge port 12. Therefore, the distance h can be shortest at the cut-off portion 13.

Since the interval h is gradually increased from the cut-off portion 13 in the air flow direction F, the flow cross-sectional area of the air channel is also increased. That is, when a width of a flow cross-sectional area is constant, the flow cross-sectional area is substantially increased due to the increase in the interval h. Accordingly, it is possible to increase a discharge flow rate of the centrifugal fan 1.

As described above, according to an embodiment of the present disclosure, it is possible to secure a high discharge flow rate by simply changing the internal air flow structure of the centrifugal fan, as compared to other centrifugal fans having the same volume.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A centrifugal fan comprising:

an impeller that suctions or discharges air;

a motor that rotates the impeller;

a housing that accommodates the impeller, the housing comprising a suction port through which air is suctioned by rotation of the impeller and a discharge port through which air is discharged by rotation of the impeller; and a cut-off portion formed at a side of the discharge port, wherein the housing further comprises an inner peripheral surface facing an outer circumference of the impeller in a radial direction of the impeller, and an inner side surface facing a lower portion of the impeller in a rotational axis direction of the impeller, wherein a cross-sectional area of an air channel for air flowing in the housing gradually increases from the cut-off portion to the discharge port in an air flow direction, wherein the lower portion of the impeller is spaced apart from a lower portion of the housing by an interval (h), a distance of the interval (h) from the lower portion of the impeller to the lower portion of the housing in a rotational axis direction of the impeller is shortest at the cut-off portion, wherein the interval (h) is gradually increased from the cut-off portion to a point in an air flow direction inside the housing and is constant from the point to the discharge port, and wherein the interval is increased up to the point at which an angle of 180° with an air discharge direction at the discharge port is formed with respect to the rotational axis direction of the impeller.

2. The centrifugal fan of claim 1, wherein an angle formed between an air discharge direction at the discharge port and the cut-off portion is in a range of 10° to 15°.

3. The centrifugal fan of claim 1, wherein the air channel is formed having a scroll shape.

4. The centrifugal fan of claim 1, wherein a distance from a rotational axis of the impeller to the inner peripheral surface of the housing in a radial direction of the impeller gradually increases from the cut-off portion to the discharge port in the air flow direction.

5. The centrifugal fan of claim 1, wherein the cross-sectional area of the air channel gradually increases from the cut-off portion to the discharge port.

6. The centrifugal fan of claim 1, wherein the width of the air channel formed in the housing gradually increases from the cut-off portion in a rotational direction of the impeller.

7. The centrifugal fan of claim 6, wherein the mounting portion protrudes from the lower portion of the housing.

8. The centrifugal fan of claim 7, wherein a lower end of the impeller is spaced apart from the lower portion of the housing.

* * * * *